US005913754A

United States Patent [19]

Lochbaum

[11] Patent Number: 5,913,754

[45] Date of Patent: Jun. 22, 1999

[54] ATTACHING SURFACE FOR AQUATIC EXERCISE DEVICES AND USERS

[76] Inventor: Kenneth Lochbaum, 3002 E. 38th St., Erie, Pa. 16510-2924

[21] Appl. No.: 08/970,570

[22] Filed: Nov. 14, 1997

Related U.S. Application Data

[63] Continuation of application No. 08/645,623, May 14, 1996, abandoned.

[51] Int. Cl.[6] ..... A63B 21/008

[52] U.S. Cl. ..... 482/111

[58] Field of Search ..... 422/111, 54

[56] References Cited

U.S. PATENT DOCUMENTS

| | | |
|---|---|---|
| 3,427,022 | 2/1969 | Ward . |
| 3,913,970 | 10/1975 | Jardin et al. . |
| 4,332,217 | 6/1982 | Davis . |
| 4,411,422 | 10/1983 | Solloway . |
| 4,576,376 | 3/1986 | Miller . |
| 4,712,788 | 12/1987 | Gaudreau, Jr. . |
| 4,721,300 | 1/1988 | Guzman . |
| 4,768,744 | 9/1988 | Leeds et al. . |
| 4,838,545 | 6/1989 | Wilson . |
| 4,918,766 | 4/1990 | Leonaggeo, Jr. . |
| 5,033,735 | 7/1991 | Erickson . |
| 5,219,317 | 6/1993 | Beasley . |
| 5,234,391 | 8/1993 | Shasek et al. ..... 482/111 |
| 5,242,352 | 9/1993 | Elliott . |
| 5,295,929 | 3/1994 | Weisz . |
| 5,533,950 | 7/1996 | Lochbaum . |
| 5,558,604 | 9/1996 | Hopkins . |

*Primary Examiner*—Lynne A. Reichard
*Attorney, Agent, or Firm*—Lovercheck and Lovercheck

[57] ABSTRACT

A support base for use with aquatic exercise devices and stabilizer which includes a body having apertures that receives and releasably secures a support for an exercise device to the base. The apertures in the base also receives and releasably secures stabilizing members which provides a way to support the exercising position of a person exercising with the device. Support base sections are also disclosed with a connecting structure to join the sections together to form a support base, and mounting structure to attach the base to the bottom of the pool, and to level the base.

20 Claims, 8 Drawing Sheets

ATTACHING SURFACE FOR AQUATIC EXERCISE DEVICES AND USERS

This application is a continuation of application Ser. No. 08/645,623 filed May 14, 1996 which application is now abandoned.

BACKGROUND OF THE INVENTION

This invention relates to exercise devices and more particularly to an attaching surface for securing aquatic exercise devices and exercising persons in position for exercising.

This invention involves a base for use with aquatic exercising equipment. The base supports the exercise device in a selected position and the user may stand on the base. Aquatic exercising equipment is intended to be used with the person doing exercises standing in water in a pool, tub, tank or other body of water. The buoyancy of the water causes the exercise equipment to be easily moved out of the desired position. Further, the people exercising in water have difficulty maintaining their position relative to the exercise device due to the buoyancy of the water. As the exerciser pushes and pulls on an exercise device, the device and the person will tend to move relative to one another. The desired result cannot be accomplished in a meaningful way when the exercise cannot be performed correctly.

The coefficient of friction between the bottom of the body of water and the feet of the person being exercised is very low. Injury, inconvenience and reduced efficiency of the exercise procedure results from the exerciser slipping on such a wet bottom surface, or from the exerciser, not being able to hold position due to buoyancy.

Applicant is aware of the following U.S. Pat. Nos. 3,427,022; 3,913,970; 4,332,217; 4,411,422; 4,576,376; 4,712,788; 4,721,300; 4,768,744; 4,838,545; 4,918,766; 5,033,735; 5,219,317; 5,242,352; 5,295,929; 5,533,950; and, 5,558,604 to Beasley for an aquatic exercise device.

SUMMARY OF THE INVENTION

Aquatic exercise and physical therapy have advantages over other forms of exercise because some invalids, particularly handicapped persons, are not physically able to fully move their legs and arms without assistance and are therefore unable to exercise efficiently without aquatic equipment. Swimming pools are not always available at convenient times and locations. Applicant has provided an improved more efficient exercise apparatus for use in pools, exercise tanks or other bodies of water.

Applicant has provided a base with a convenient and efficient means to support and secure the exercise equipment in place. It is necessary to secure the exercise equipment in place due to the buoyancy of the water and the forces applied to the equipment by the exerciser. The base has a top surface that provides a high coefficient of friction between it and the wet feet or shoes of the user. A rough or textured surface may be provided so that the feet or shoe bottoms of the user can more readily grip the top surface. A convenient and efficient support is provided so that the exercising device can be readily and removably supported on the base. The user can stand on the base while using the device, or the user can stand on the bottom of the body of water.

A stabilizer may be used by the exerciser to support him in exercise position relative to the exercise device. The stabilizer is releasably securable to the base and provides structure to engage the exerciser. This structure may be provided to engage the foot of the exerciser or may be provided to engage the body of the exerciser in a standing or sitting position. Flexible straps may be provided to secure the exerciser to the stabilizer.

The base member may be provided in sections, the sections being provided with connecting structure to secure adjacent base sections together, and mounting apparatus to secure the base sections to the bottom of the body of water.

Persons with weakened muscles who have difficulty lifting their arms and legs can exercise efficiently with the aquatic device disclosed herein. A particular aquatic exercising device is disclosed having a swinging frame that can be used in any body of water having a bottom to support the device. The device has openings with adjustable closures by which the resistance of the device to movement through the water can be adjusted.

A particular base is disclosed to act as both a support for the device and as a base on which the exercising person may or may not stand on.

It is an object of the invention to provide an improved base for use by a person in a body of water to stand on and to support the exercise device.

Another object of the present invention to provide a tank and a base having an attaching surface for infinite supporting positions for various devices for aquatic use.

Another object of the present invention is to provide an exercise device and a base for aquatic use that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 5:
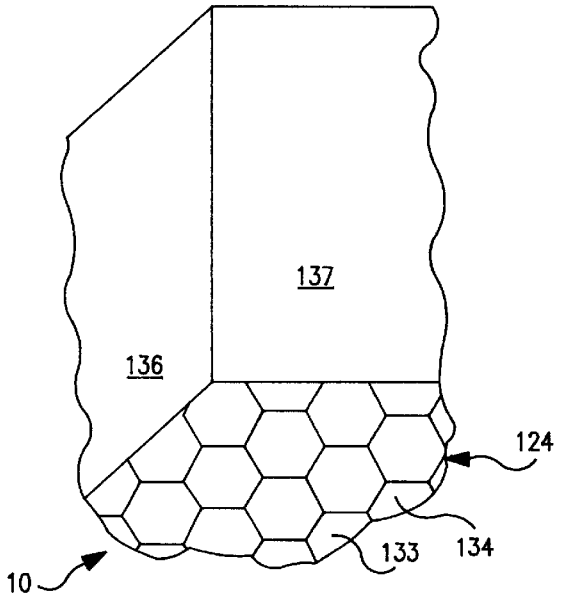
FIG. 5 is a partial isometric view of a body of water with the bottom covered with a base, the base having hexagonal apertures according to the invention.
Figure 6:
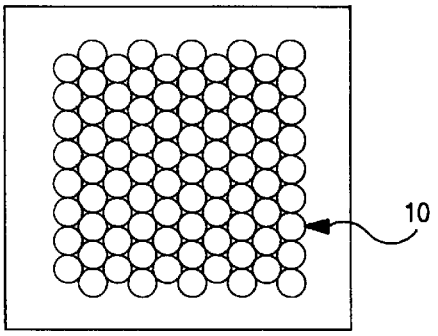
FIG. 6 is a top view of a base having circular apertures according to the invention.
Figure 7:
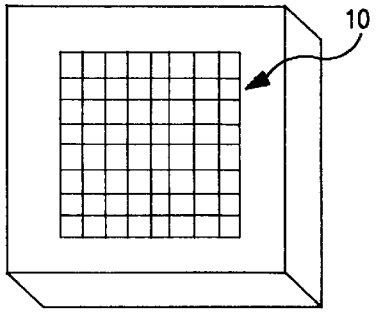
FIG. 7 is a top view of another embodiment of the base with square apertures.

Now with more specific reference to the drawings, shown is aquatic exercise base 10. Base 10 is provided to support aquatic exercise device 12 in a predetermined exercise position and also to support person 14 in a preferred exercise position by aquatic foot stabilizer 16. The buoyancy of the water makes both exercise device 12 and exercising person 14 easily displaced from their working positions as exercise device 12 is manipulated when the exercise is taking place. Aquatic exercise device 12 is adapted for use in body of water 18 which may be a pool, exercise tank or pond for example. Body of water 18 has bottom 20, surface 22 and the depth between the bottom surface being a predetermined desired distance to provide an aquatic exercise environment. Aquatic exercise base 10 may cover entire bottom 20 with body of water 18 or a predetermined area thereof. Base 10 may be permanently attached or removably attached to bottom surface 26. Base 10 has top surface 24, bottom surface 26 and side surface 28 extending around the perimeter of base 10. Top surface 24 has at least one aperture 30 which is adapted to receive and releasably secure support posts 32 by exercise device 12 to releasably secure aquatic exercise device 12 by a predetermined position by the person exercising or being supervised. Aperture 30 is also adapted to receive and releasably engage support posts 34 of foot restraint 16 to restrain the person in a predetermined exercise position with relation to exercise device 12. A number of apertures 30 may be provided in upper surface 24 and extending into base 10 in the preferred embodiment array of apertures 30 may be provided so that a wide range of positions may be selected for exercise device 12 and foot restraints 16. Aperture 30 may be made in any number of shapes, including, hexagonal as shown in FIG. 5, circular as shown in FIG. 6, or square as shown in FIG. 7. Other cross sectional shapes may also be used.

Figure 10:
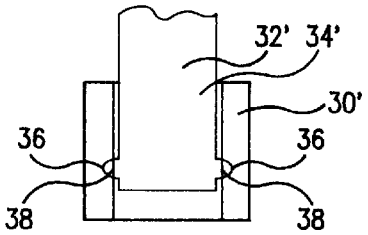
FIG. 10 is a side view in cross section showing a snap type fastener securing a support post in an aperture according to the invention.

Support posts 32,34 are secured in apertures 30 by engaging means. Engaging means may be the lower ends of support posts 32,34 being sized to provide a friction fit in apertures 30. A snap fit or other engaging means may also be provided as shown in FIG. 10 where aperture 30' is provided with recess 36 into which snap member 38 will move when support posts 32',34' are inserted into aperture 30'. Support posts 32,34 may follow the shape of apertures 30 for maximum restraint, or may be shaped to only partially engage apertures 30 surface. For example, for use in a circular aperture, support posts 32,34 may be triangular, square, hexagonal, octagonal, or oval to provide sufficient engagement with the aperture side walls. In the square or hexagonal apertures, a round support post may be used to provide an incomplete frictional fit.

Figure 2:
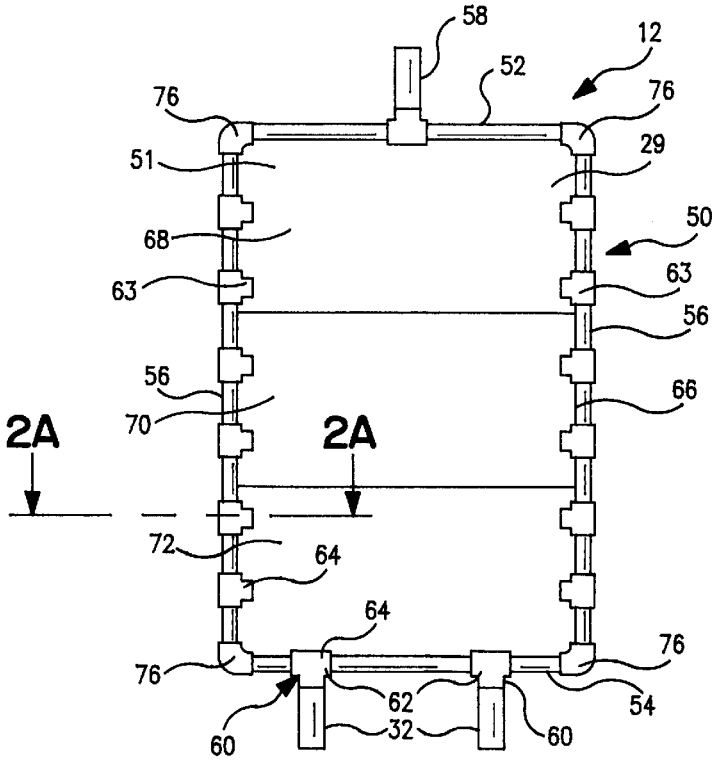
FIG. 2 is a front view of the aquatic exercising device according to the invention as shown in FIG. 1.
Figure 2A:
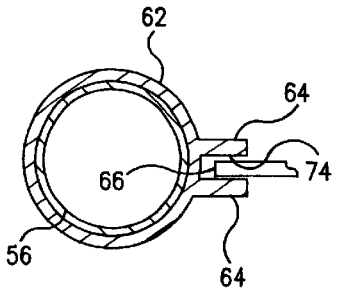
FIG. 2A is a cross sectional view taken on line 2A—2A of FIG. 2.

As shown in FIG. 2, aquatic exercise device 12 is made up of generally rectangular frame 50 encloses opening 51 and has top 52, bottom 54, sides 56, handle 58 and support posts 32 attached to bottom 54 by hinge means 60. As shown in FIG. 2*a,* T-fittings 63 each have branches 64 for receiving side edges 66 of sliding panels 68,70,72 in slot 74. T-fittings 62 hingedly support bottom bar 54 and rigidly supports support posts 32.

Base 10 is used with body of water 18 such as aquatic exercise tank 19, a swimming pool or other pool. Tank 19 may be of any depth or any lateral dimension suitable for the purpose. In the example shown, the depth of water should be great enough to submerge frame 50 below the top surface of body of water 18 below handle 58. When a person exercising in body of water 18 stands on base 10 and grasps handle 58, he can pull handle 58 toward himself, thereby swinging frame 50 on support posts 32 through hinge means 60. Swinging of frame 50 will be resisted by water on sliding panels 68,70,72 which are slidably received in slots 74 in branches 64 of T-fittings 62. Sliding panels 68,70,72 can fill or close opening 51 in frame 50 like double hung windows. By sliding panels 68,70,72 to overlay one another, the area enclosed by frame 50 can be opened. Sliding panels 68,70, 72 vary the resistance of exercise device 12 by positioning panels 68,70,72 to more or less fill the area enclosed by frame 50.

In the example shown, frame 50 is made of plastic plumbing fittings of a type familiar to those skilled in the art. Top 52, bottom 54 and sides 56 may be made of plastic pipes held together by T-fittings 62. The corners of frame 50 are held together by elbow fittings 76. Handle 58 and support posts 32 are plastic pipes held together by the fittings shown. Support posts 32 are cemented to hinge means 60, thereby providing hinge joints between frame 50 and support posts 32. Hinge means 60 is free to rotate on the pipe forming bottom 54 of exercise device 12.

Figure 1:
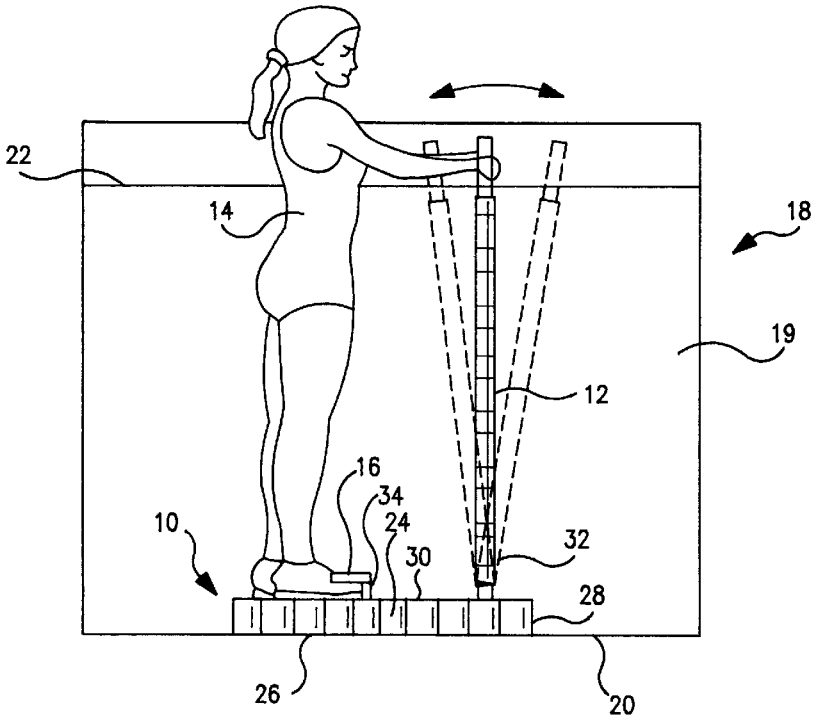
FIG. 1 is a side view of a body of water with one side wall removed showing an exercising device supported on a base according to the invention.

FIG. 1 shows base 10 having sides 28 and round apertures 30, which may be made of plastic or any suitable material. Base 10 may be molded, extruded or fabricated. Top surface 24 forms an uneven surface for the feet of a person exercising.

Figure 3:
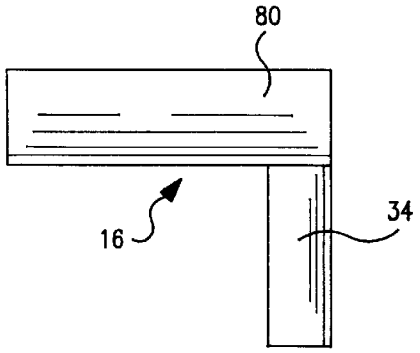
FIG. 3 is a side view of a foot stabilizer with one supporting post according to the invention for use with the base as shown in FIG. 1.
Figure 4:
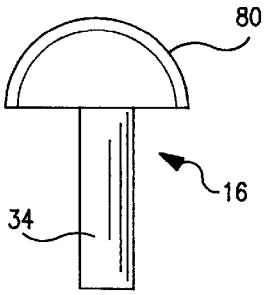
FIG. 4 is an end view of the one post foot stabilizer shown in FIG. 3 according to the invention.
Figure 17:
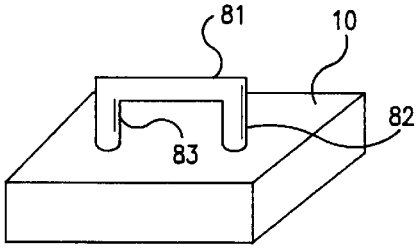
FIG. 17 is of a two post foot stabilizer bar according to the invention.

Aquatic foot stabilizer 16, shown in FIGS. 3 and 4, has support bar 80 attached to support post 34. Post 34 is adapted to be received in one of apertures 30, in base 10, for use by an exercising person using frame 50 or other aquatic exercise device. The person can insert the front of his foot between support bar 80 and top surface 24 of base 10 to hold his foot from slipping on top surface 24 of base 10. A foot stabilizer may be provided with two support posts 87,88, as shown in FIG. 17. Foot stabilizer 80 is provided with cross member support bar 81 and two vertical members, first support post 82 and second support post 83. Support posts 82,83 being adapted to engage apertures 30 in exercise base 10.

Figure 19:
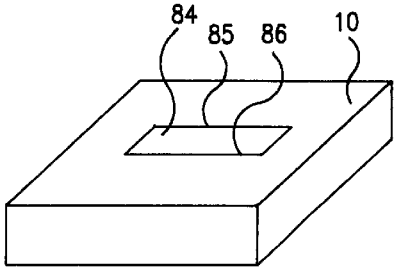
FIG. 19 is of the second embodiment of a two post foot stabilizer shown secured to a base according to the invention.
Figure 18:
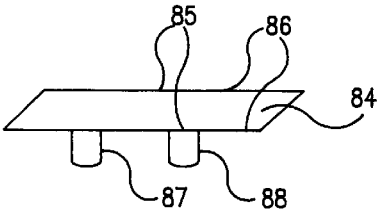
FIG. 18 is of a second embodiment of a two post foot stabilizer with restraining straps according to the invention.

In another embodiment, as shown in FIGS. 18 and 19, a foot stabilizer is provided that is generally flush with the upper surface of base 10. Foot stabilizer is made up of a foot stabilizer plate 84 having first flexible foot restraint 85 and second flexible foot restraint 86 fixed to its upper surface and adapted to retain the foot of an exercising person. First support post 87 and second support post 88 extends downwardly from the bottom of foot stabilizer plate 84 and are adapted to engage apertures 30 in base member 10.

Figure 12:
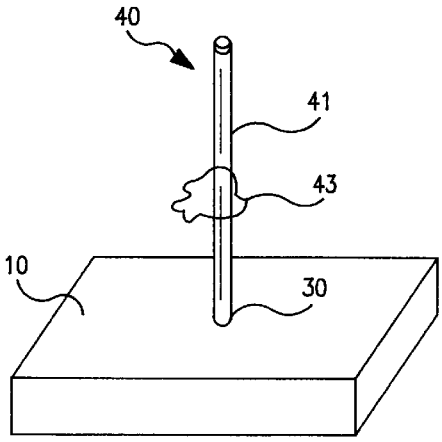
FIG. 12 is an isometric view of a single upright stabilizer bar according to the invention.

The aquatic exercise equipment may also comprise an upright stabilizer bar 40. Upright stabilizer bar is shown in FIG. 12 as single upright stabilizer member 41 which is releasably secured at its lower end in aperture 30 of base 10. It may be provided with restraining belt 43 to secure the exercising person in a desired exercise position.

Figure 13:
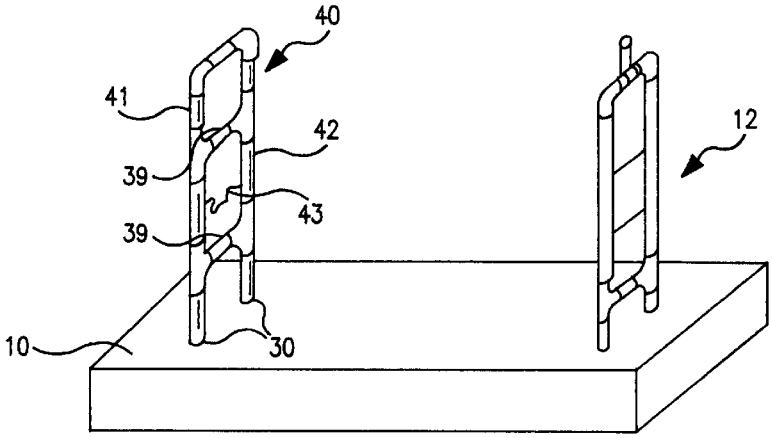
FIG. 13 is an isometric view of a dual upright stabilizer bar and an aquatic exercise device according to the invention.

As shown in FIG. 13, upright stabilizer bar 40 may be made up of first upright member 41 and second upright member 42 which are rigidly supported generally parallel to each other by cross members 39. The lower ends of upright members 41,42 are adapted to be received in apertures 30 in exercise base 10. One or more restraining belts 43 may be provided to secure an exercising person to upright stabilizer bar 40 to maintain them in a desired exercise position relative to the exercise device 12 or other exercise devices.

Figure 14:
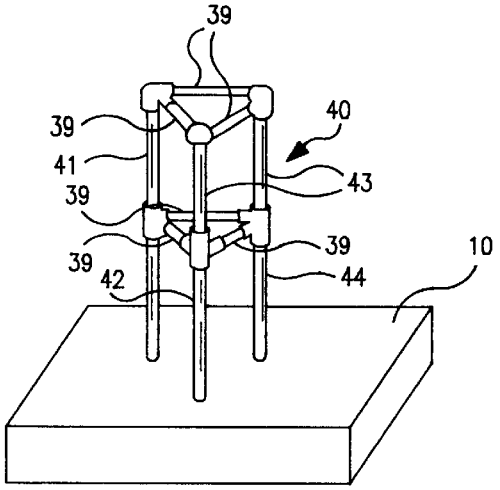
FIG. 14 is a triple upright stabilizer bar with generally parallel upright members according to the invention.

As shown in FIG. 14, upright stabilizer bar 40 may be made up of first upright member 41, second upright member 42 and third upright member 44 which are rigidly supported generally parallel to each other by cross members 39. The lower ends of upright members 41,42,44 are adapted to be received in aperture 30 in exercise base 10. One or more restraining belts 43 may be provided to secure the exercising person to upright stabilizer bar 40 to maintain them in a desired exercise position.

Figure 14A:
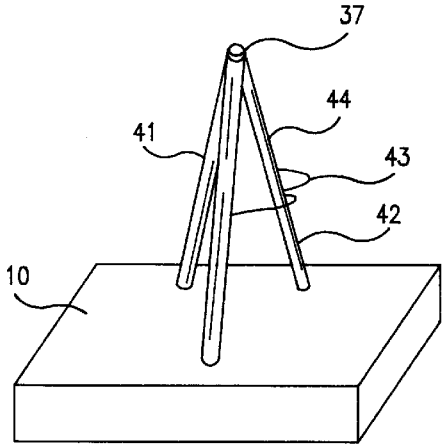
FIG. 14A is a triple upright stabilizer bar with uprights that generally meet at their upper ends for support.

As shown in FIG. 14A, upright members 41,42,44 may generally meet at their upper ends and be joined together with top member 37.

Figure 15:
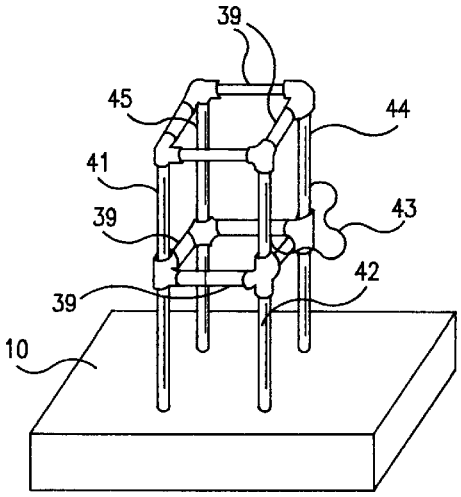
FIG. 15 is a quadruple upright stabilizer bar with generally parallel uprights according to the invention.

As shown in FIG. 15 upright stabilizer bar 40 may be made up of first upright member 41, second upright member 42, third upright member 44 and fourth upright member 45 which are rigidly supported generally parallel to each other by cross members 39. The lower ends of upright members 41,42,44,45 are adapted to be received in apertures 30 in exercise base 10. One or more restraining belts 43 may be provided to secure the exercising person to upright stabilizer bar 40 to maintain them in an exercising position.

Figure 15A:
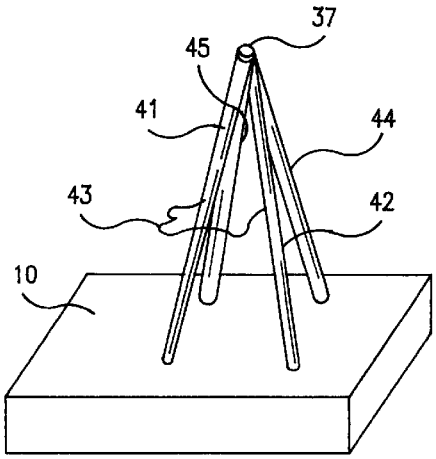
FIG. 15A is a quadruple upright stabilizer bar with uprights that generally meet at their upper ends for support.

As shown in FIG. 15A, upright members 41,42,44,45 may generally meet at their upper ends and be joined together with top member 37.

Figure 16:
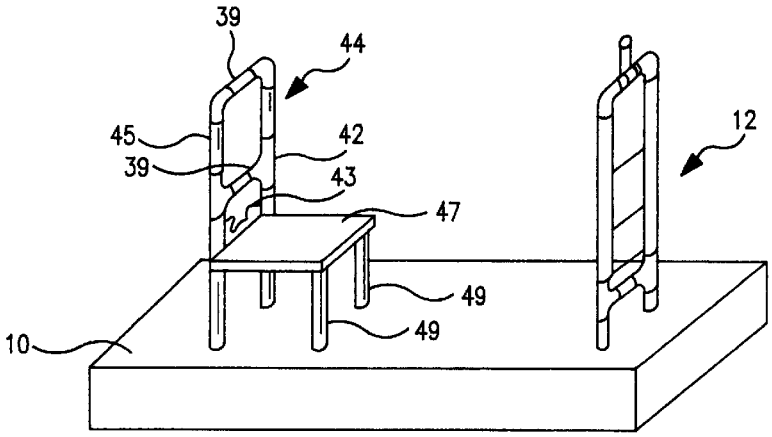
FIG. 16 is a sitting stabilizer bar and an aquatic exercise device according to the invention.

As shown in FIG. 16, sitting stabilizer bar 46 may be made up of first upright member 41, second upright member 42, seat 47, first leg 48 and second leg 49 attached to the front corners of seat 47. First and second upright members 41,42 are rigidly supported generally parallel to each other by cross members 39. Lower ends of upright members 41,42 and first leg 48 and second leg 49 are adapted to be received in aperture 30 in exercise base 10. One or more restraining belts 43 may be provided to secure an exercising person to sitting stabilizer bar 46 to maintain them in a desired exercise position.

Two foot restraints shown in FIG. 17 have support posts 82,83 spaced from each other providing place for both feet to be restrained. A foot restraint may also be provided with two spaced support posts, providing a foot space therebetween to more firmly restrain one foot.

FIG. 5 shows base 124, according to applicant's invention, having hexagonal-shaped apertures 134 extending from wall 136 to wall 137. Hexagonal-shaped apertures 134 are equally spaced laterally, longitudinally and diagonally, so that an exercising device having one or more posts can be supported in any direction.

FIG. 6 shows base 10 having round apertures 30.

FIG. 7 shows base 10 having square-shaped apertures.

Figure 8:
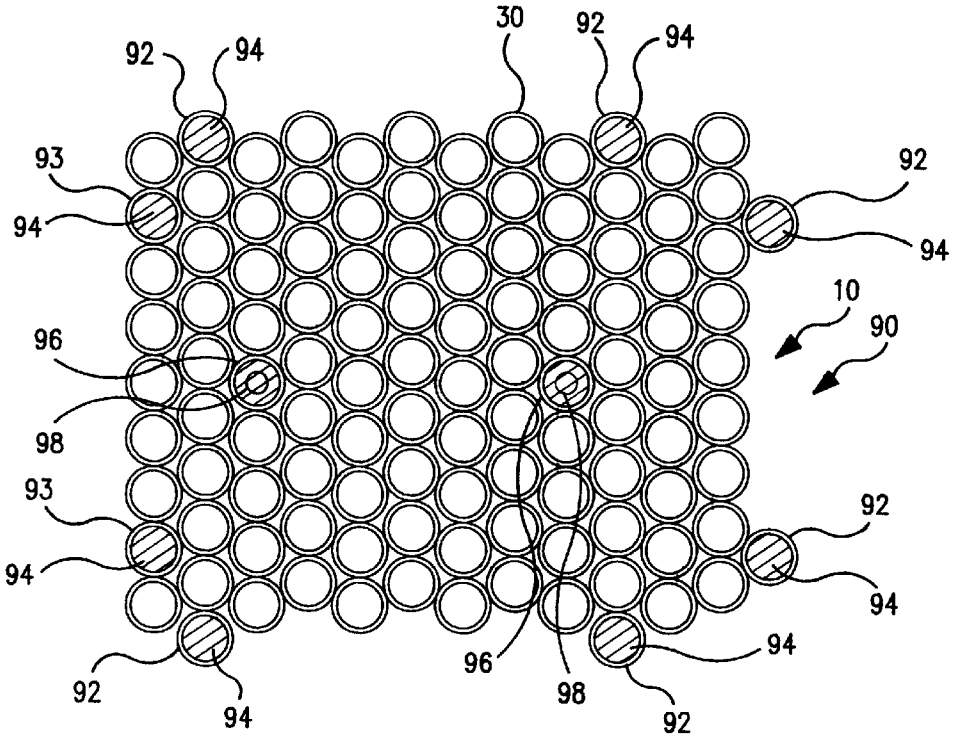
FIG. 8 is a top cross sectional view taken on line 8—8 of FIG. 9 of a base section showing an array of apertures and showing a connecting aperture to secure adjacent base sections together according to the invention.
Figure 9:
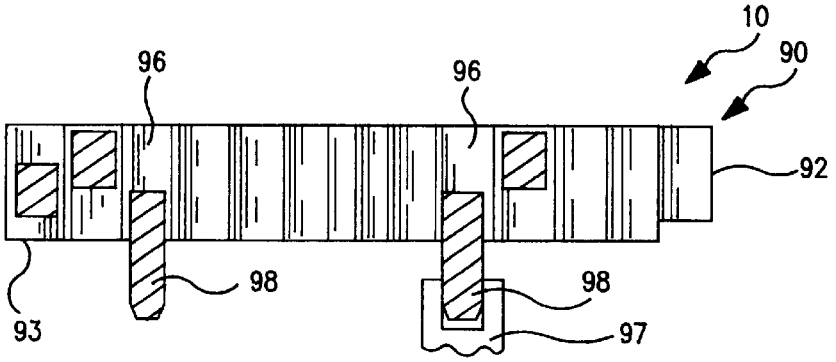
FIG. 9 is a cross sectional view taken on line 9—9 of FIG. 8 of a base section showing connecting tubes and pins to secure sections and mounting pins to secure the section to the substrate according to the invention.

Aquatic exercise base 10 may be made up of an array of interlocking base sections 90 as shown in FIGS. 8 and 9. Each base section 90 has at least one aperture 30 which is adapted to receive and releasably secure support posts 32,34, 32',34'. Each section is provided with at least one connecting tube 92 which is aligned with a corresponding connecting tube 93 when the sections are laid side by side. Connecting pins 94 in connecting tube 92 slides down into connecting tubes 93 to secure sections 90 together. To secure the sections to bottom 20 of body of water 18 mounting tubes 96 are provided with mounting pins 98 which may be expandable pins. Mounting pins 98 may be secured in mounting sleeves 97 embedded in the bottom of the pool or other body of water 18.

Figure 11:
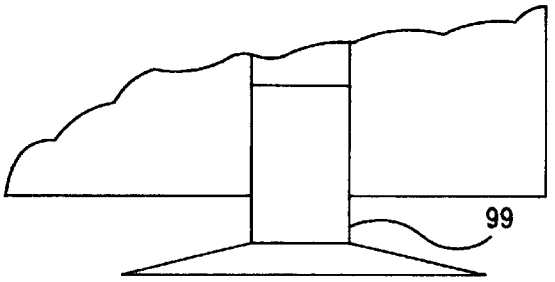
FIG. 11 is a side view of an alternative mounting structure comprising suction cups to secure the base section in place according to the invention.

In another embodiment as shown in FIG. 11, mounting pins 98 are replaced with suction cups 99. This securing means is particularly desirable for pools with vinyl liners, for example, where it would not be advantageous to cut holes for pins 98. Suction cups 99 are also suitable for applications where extreme side forces will not be imposed on the securing means, for example, for facilities used exclusively for rehabilitation exercises or where the grid system covers the entire bottom of a pool and sideward movement is restrained by the sides of the pool.

Figure 20:
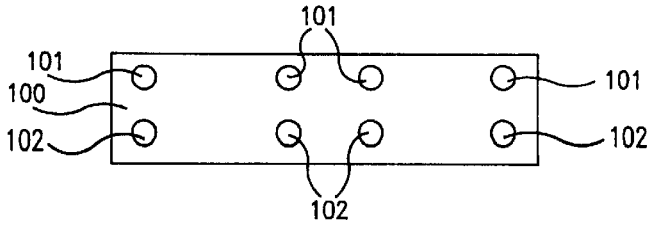
FIG. 20 is a top view of a connecting plate according to the invention.
Figure 21:
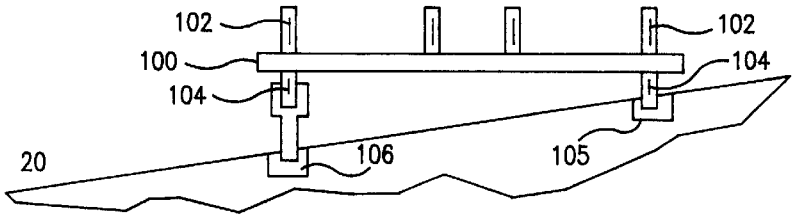
FIG. 21 is a side view of a connecting plate and studs and a stud sleeve shown supported on an inclined portion of a pool bottom according to the invention.

In another embodiment, as shown in FIGS. 20 and 21, interlocking base sections 90 may be secured to one another by means of connecting plate 100 and connecting studs 101,102 as shown in FIG. 20. Connecting plate 100 will be positioned at each location where adjacent base sections 90 are to be secured together.

Figure 22:
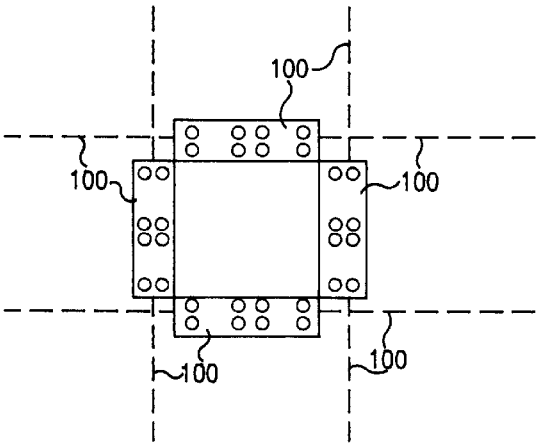
FIG. 22 is a top view of an array of connecting plates as they would be positioned to secure an array of base sections together according to the invention.

FIG. 22 shows an array connecting plates 100 positioned to attach a number of base sections 90 together to form aquatic exercise base 10. Each connecting plate 100 has first row of connecting studs 101 which are welded or otherwise affixed to the connecting plate and extending upwardly therefrom, connecting studs 101 being adapted to engage and secure first base section 90. Each connecting plate 100 has second row of connecting studs 102 which are adapted to engage and secure second base section. Thus, connecting plate 100 secures adjacent base sections 90 together with connecting studs 101,102.

Figure 20A:
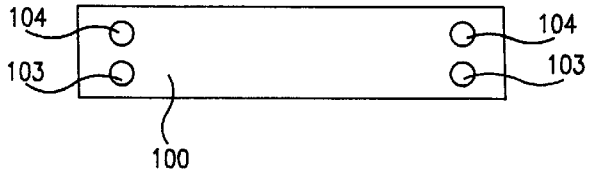
FIG. 20A is a bottom view of a connecting plate according to the invention.

As shown in FIG. 20A, first side mounting studs 103 extend downwardly from connecting plates and are received in stud mounting sleeves 105 which are secured to the bottom of body of water 18. Stud leveling sleeves 106 may be provided in any necessary length to provide a level support for base section 90. Second side mounting studs 104 extend downwardly from connecting plate 100 and are received in stud mounting sleeve 105 which are secured to the bottom of body of water 18. Stud leveling sleeves 106 may be provided in any necessary length to provide a level support for base sections 90.

The problem of sloping bottom 20 of body of water 18 are overcome with stud sleeves 106 which may be provided in different lengths to support the joined base sections in a level plane as shown in FIG. 21.

Figure 23:
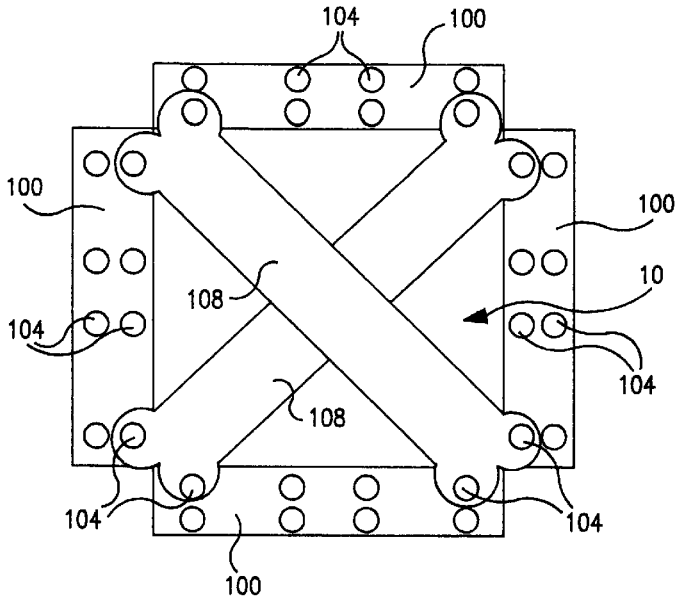
FIG. 23 is a top view with the base section removed showing the connecting plates and stud straps secured diagonally across the underside of the base section to support the base section according to the invention.

The problem of supporting the center areas of base sections can be addressed as necessary with the addition of support straps 108 diagonally secured to studs 104 at the corners of base section 90 and connecting plate 100 as shown in FIG. 23.

Figure 24:
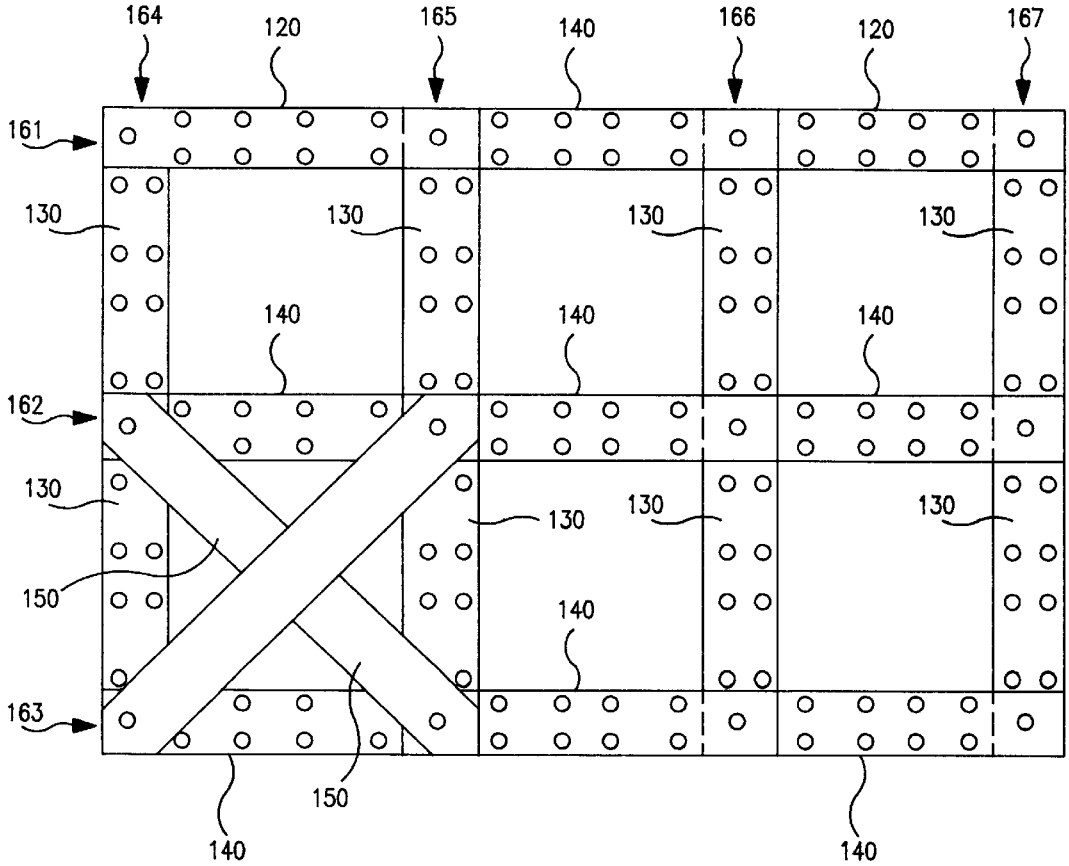
FIG. 24 is a top view of an array of connecting plates as they would be interconnected together to secure an array of base sections together and also showing support straps according to another embodiment of the invention.

In another embodiment as shown in FIG. 24, the connecting plates are made longer than the base sections so that the plates directly interconnect with each other rather than indirectly through the base sections to provide a stiffer base. The connecting plates are provided in three different configurations: the two end post connecting plate 120, the one end post connecting plate 130 and the no end post connecting plate 140. When the plates are arranged in an array, the bottom plate at each position where the plates meet has an upwardly extending end post. Each of the connecting plates which overlie the first connecting plate has a hole in that end while will fit over the post securing the array in position. The posts are positioned at approximately each corner of each base section when they are in place. To complete the structure, supporting straps 150 are provided which extend diagonally beneath each base section to support it in a level plane.

Figure 26:
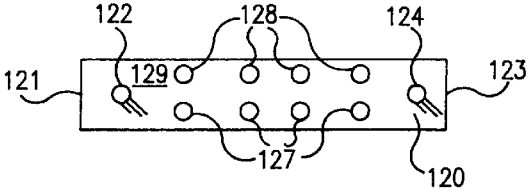
FIG. 26 is a top view of the two post connecting plate shown in FIG. 25.
Figure 25:
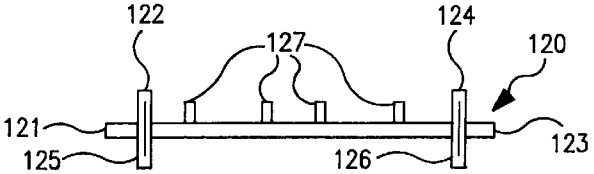
FIG. 25 is a side view of a two post connecting plate according to the invention.

As shown in FIGS. 25 and 26, two post connecting plate 120 has first end 121 having a first end post 122 adjacent thereto and extending upwardly therefrom. Two post connecting plate 120 also has a second end 123 having a second end post 124 adjacent thereto and extending upwardly therefrom. The first end also has a first mounting stud 125 adjacent thereto and extending downwardly therefrom. The second end also has a second mounting stud 126 adjacent thereto and extending downwardly therefrom. The two post connecting plate is provided with a first row of connecting studs 127 and a second row of connecting studs 128 extending upwardly from the top side 129 of the two post connecting plate 120. The first row of connecting studs 127 will engage a first base section and the second row of connecting studs 128 will engage a second base section thereby rigidly receiving them together.

Figure 27:
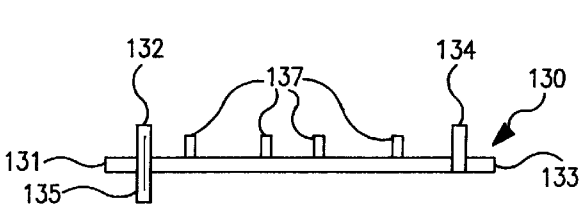
FIG. 27 is a side view of a one post connecting plate according to the invention.
Figure 28:
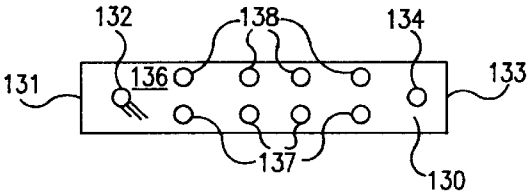
FIG. 28 is a top view of the one post connecting plate shown in FIG. 27.

As shown in FIGS. 27 and 28, the one post connecting plate 130 has a first end 131 having a first end post 132 adjacent thereto and extending upwardly therefrom. The one post connecting plate also has a second end 133 having a second end hole 134 adjacent thereto and extending therethrough. The first end also has a first mounting stud 135 adjacent thereto and extending downwardly therefrom. The one post connecting plate is provided with a first row of connecting studs 137 and a second row of connecting studs 138 extending upwardly from the top side 136 of the one post connecting plate 130. The first row of connecting studs 137 will engage a first base section and the second row of connecting studs 138 will engage a second base section, thereby rigidly securing them together.

Figure 30:
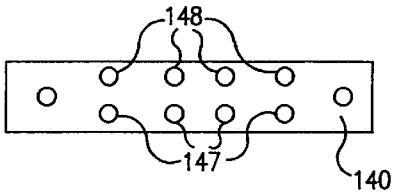
FIG. 30 is a top view of the no post connecting plate shown in FIG. 29.
Figure 29:
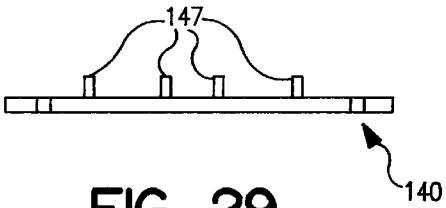
FIG. 29 is a side view of a no post connecting plate according to the invention.

As shown in FIGS. 29 and 30, the no post connecting plate 140 has a first end 141 having a first end hole 142 adjacent thereto and extending therethrough. The no post connecting plate 140 has a second end 143 having a second end hole 144 adjacent thereto and extending therethrough. The no post connecting plate is provided with a first row of connecting studs 147 and a second row of connecting studs 148 extending upwardly from the top side 145 of the no post connecting plate 140. The first row of connecting studs 147 will engage a first base section and the second row of connecting studs 148 will engage a second base section, thereby rigidly securing them together.

Figure 31:
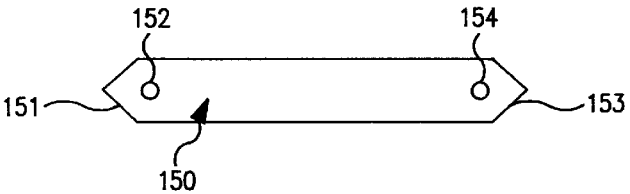
FIG. 31 is a top view of the supporting strap according to this embodiment of the invention.

Support straps 150 may be used to support the base section. As shown in FIG. 31, the support straps 150 each have a first end 151 within a first end hole 152 adjacent thereto and extending therethrough. They also have a second end 153 with a second end hole adjacent thereto and extending therethrough. Support straps 150 may be extended diagonally beneath each base section and the end holes slip over the post at each corner of the base section.

As shown in FIG. 24, the two post, one post and no post connecting plates may be combined to form an array to which base sections may be secured to form a continuous base. For example, as illustrated a two post connecting plate 120 may be placed alternately in a row no post connecting plates 140 to form a first row 161. Additional connecting plates may be added to extend the row to any desired distance. Each end hole of the no post connecting plate engages the adjacent post of each of the adjacent two post connecting plates. First column 164, second column 165, third column 166 and fourth column 167 may be formed with one post connecting members 130 each placed with hole 134 over the post of the connecting member in the first row 161. Additional one post connecting plates 130 may be added to extend the columns to any desired distance. Second row 162 and third row 163 may be made up of no hole connecting plates 140 as shown and may be extended to any desired distance. Various arrangements of connecting plates may be used to provide the desired size array to support the base sections.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An aquatic exercise base for use in a body of water having a bottom comprising;

said base having a relatively flat top surface, a relatively flat bottom surface and an outer surface;

said top surface having a plurality of apertures formed therein;

each said aperture being adapted to releasably secure a post whereby said post may be releasably received in one of said apertures;

a seat supported on at least one of said posts;

said outer surface forming a side wall extending around said base;

said bottom surface of said base being supported on a bottom of a body of water.

2. The base recited in claim 1 wherein said seat further comprises an upwardly extending member forming a seat back.

3. A base section and a body of water having an enclosure with a bottom;

mounting means affixed to said base to secure said base to the enclosure of said body of water;

said base having a flat top surface and a flat bottom surface;

a plurality of post receiving apertures formed in said top surface and extending into said base;

a post being releasably supported in one of said post receiving apertures and extending upwardly therefrom;

further comprising means for stabilizing an exerciser whereby an exerciser is able to maintain an exercise position while completing an exercise;

said means for stabilizing an exerciser comprising a seat member;

said post supporting said seat member adjacent the upper end thereof; and said seat member having a seat adapted to support an exerciser.

4. A base as recited in claim 3 wherein said stabilizer means comprises a seat member;

said seat member having a seat adapted to support an exerciser and a leg attached adjacent each corner of the seat and extending downwardly therefrom; and, said leg having a support post at its lower end adapted to be received in apertures in said base.

5. The base as recited in claim 4 wherein said seat member stabilizer means further comprises upwardly extending members forming a seat back.

6. The base recited in claim 3 wherein said seat further comprises an upwardly extending member forming a seat back.

7. An aquatic exercise base for use in a body of water having a bottom comprising;

at least two base sections each said base section having a top surface with at least one aperture, a bottom surface to rest on said bottom of said body of water and an outer surface;

said apertures extending into said base sections; and, attaching means on said base sections adjacent said outer surfaces being adapted to releasably secure each of said base sections to at least one adjacent base section.

8. The aquatic exercise base recited in claim 7 wherein said support post is a downwardly extending part of an aquatic exercise device.

9. The base section recited in claim 7 further comprising mounting means in said bottom surface to releasably secure said base section to a subjacent surface.

10. The base section recited in claim 9 wherein said mounting means comprises at least one downwardly extending mounting pin.

11. The base sections recited in claim 7 wherein said base sections attach together to form a base member.

12. The base recited in claim 7 further comprising a post releasably secured in said aperture and extending upwardly therefrom.

13. The base recited in claim 12 further comprising a seat member; and, said seat member having a seat adapted to support an exerciser.

14. The base recited in claim 13 wherein said seat further comprises an upwardly extending member forming a seat back.

15. A base to be supported on a pool bottom comprising;

a plurality of tubes of substantially equal length secured together in side-by-side relation to each other;

some of said tubes having an upper end disposed in a common plane with other said tubes defining a supporting surface for a person;

some of said tubes having a lower end resting on said pool bottom;

an aperture in at least one of said tubes;

a post releaseably received in one of said tubes and extending upwardly therefrom; and, a seat supported on said post.

16. The base recited in claim 15 wherein at least one of said tubes has a securing means for securing said base to said pool bottom.

17. The base recited in claim 16 wherein the securing means comprises a mounting pin extending downwardly from said tube;

said mounting pin has a mounting means thereon adapted to be received in said aperture means in said pool bottom.

18. The base recited in claim 17 wherein said mounting means in said pool bottom comprises at least one aperture in said pool bottom;

a sleeve in said aperture receiving said mounting pin.

19. The base recited in claim 15 wherein a second base is disposed in an array of base sections;

each said base section having at least one aperture adapted to releasably secure said support post;

each said base section having at least one connecting tube aligned with a corresponding connecting tube wherein said base sections are disposed in side-by-side relation;

a connecting pin in one said connecting tube adapted to be moved into said corresponding connecting tube to secure said base sections together.

20. The base recited in claim 15 wherein said base comprises at least two sections supported, adjacent one another;

each said section has at least one aperture which is adapted to releasably receive said post;

each said section is provided with at least one of said tubes being a connecting tube which is aligned with a corresponding connecting tube on an adjacent said section whereby said sections may be held in side-by-side position.

* * * * *